US007275651B2

(12) United States Patent
Morales et al.

(10) Patent No.: US 7,275,651 B2
(45) Date of Patent: Oct. 2, 2007

(54) DOUBLE-SKIN, LOW-PROFILE, ENVIRONMENTAL, SAFETY TANK SYSTEM

(76) Inventors: Kevin L. Morales, 4104 Country Dr., Bourg, LA (US) 70343; John L. Guidry, II, 169 E. 51 St., Cut Off, LA (US) 70345

( * ) Notice: Subject to any disclaimer, the term of this patent is extended or adjusted under 35 U.S.C. 154(b) by 0 days.

(21) Appl. No.: 10/702,423

(22) Filed: Nov. 6, 2003

(65) Prior Publication Data

US 2005/0098559 A1 May 12, 2005

(51) Int. Cl.
*B65D 51/16* (2006.01)

(52) U.S. Cl. ..... 220/203.23

(58) Field of Classification Search ..... 220/203.28, 220/560.03, 4.12, 542, 502, 562, 567.1, 567.2, 220/918, 921, 62.18, 495.01; 73/290, 322.5, 73/305, 294

See application file for complete search history.

(56) References Cited

U.S. PATENT DOCUMENTS 1,563,199 A * 11/1925 Leland ..... 220/747
2,073,990 A * 3/1937 Koch ..... 220/1.5
4,648,521 A * 3/1987 Thomas et al. ..... 220/1.5
4,746,034 A * 5/1988 Ata et al. ..... 222/143
5,385,233 A * 1/1995 McKibben et al. ..... 206/386
5,497,895 A * 3/1996 Rudbach ..... 220/4.33
5,794,818 A * 8/1998 Bromwell et al. ..... 222/105

* cited by examiner

*Primary Examiner*—Jes F. Pascua
*Assistant Examiner*—Shawn Braden

(57) ABSTRACT

A stainless steel, double-skin, industrial, tote tank (100) for transporting dangerous liquids between a dock and an off-shore platform having inner and out tank "skins," with the opposing walls gapped, except for the flatly engaged, bottom walls. A low-profile 550 gallon tank design has about a four foot height, six foot length and four foot width, allowing a worker to easily view and work with a liquid level gauge and the top fill openings while merely standing next to the tank. The tank top includes a high wall around all of the operative, top elements, confining any spilled liquid, with a typically closed drain line located in the top wall extending to the side for emptying of the spilled liquid. A protectively enclosed, discharge valve line having a bottom drip pan is included at the sloped tank bottom completely within the tank wall confines with a lock-able access door.

16 Claims, 6 Drawing Sheets

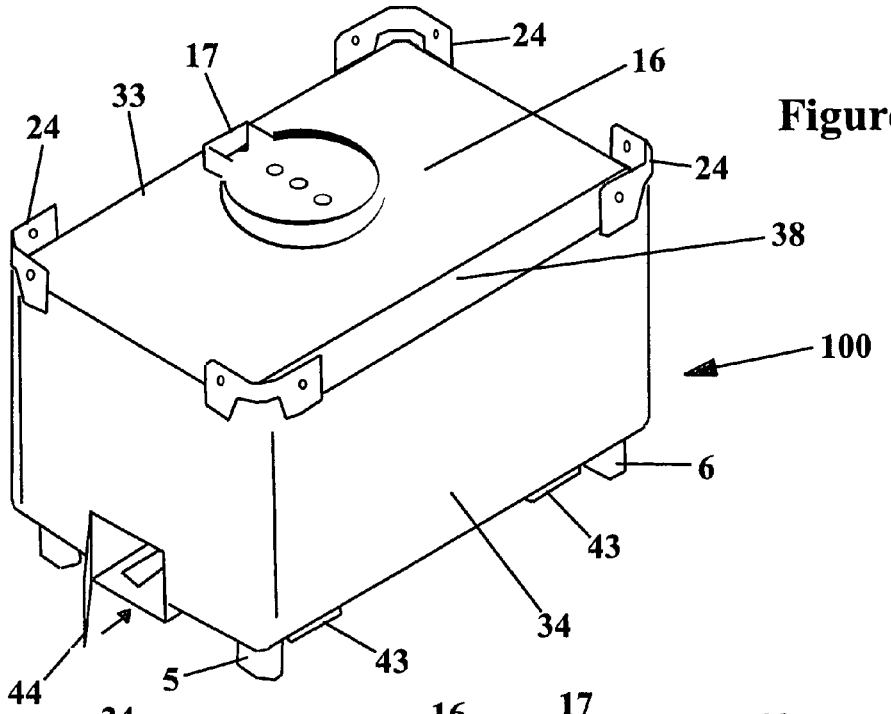
Figure 1
Figure 2
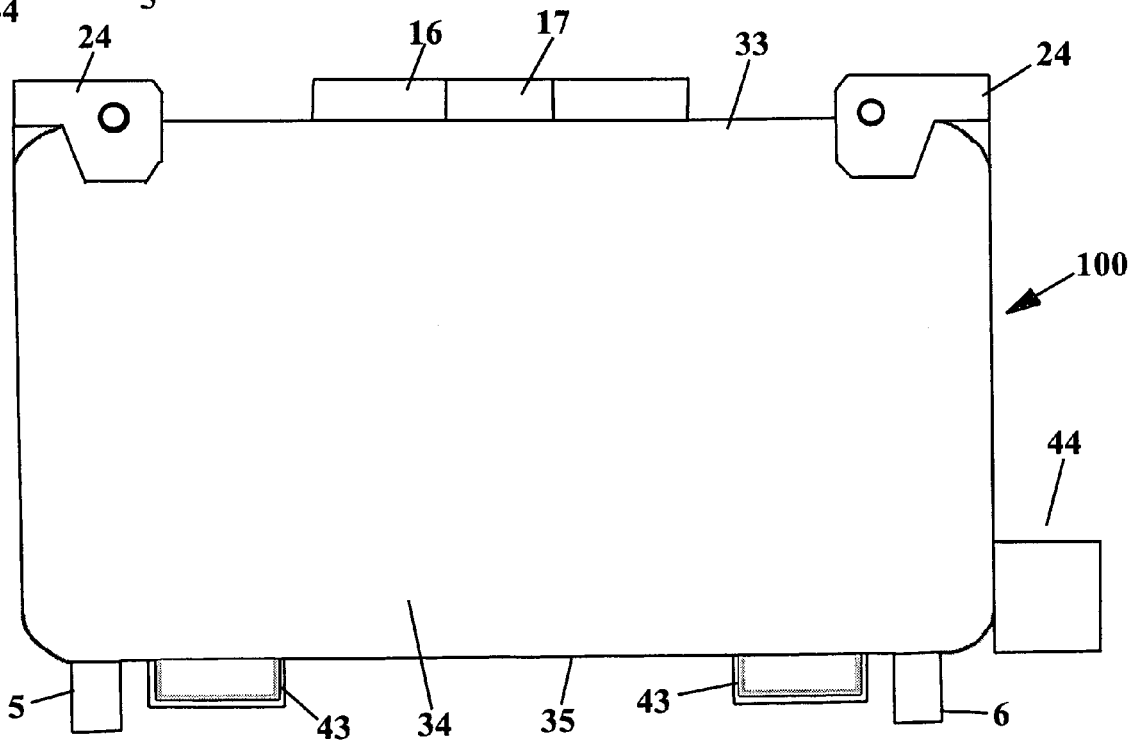

Figure 5A
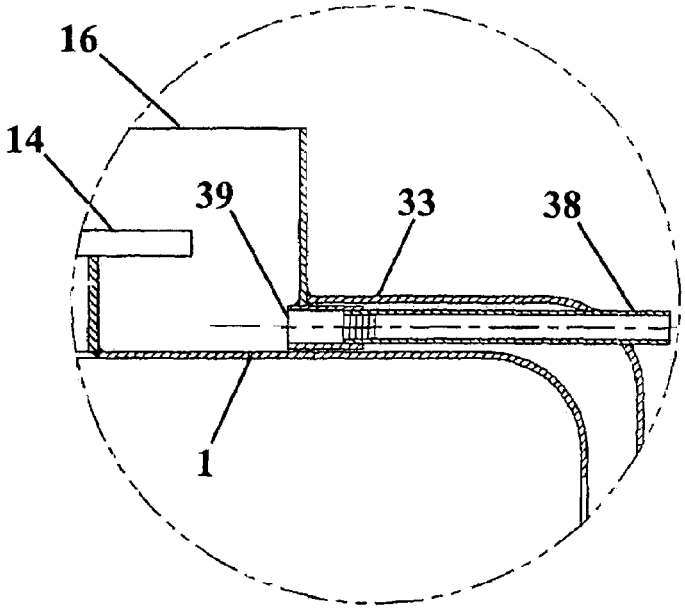
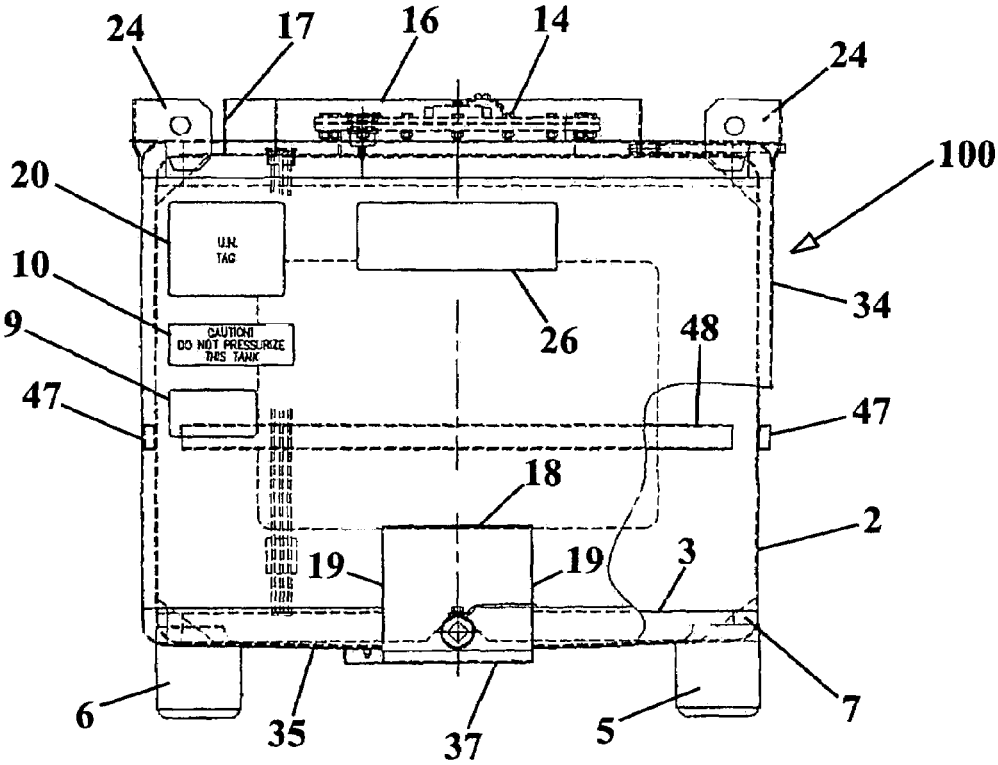
Figure 5

DOUBLE-SKIN, LOW-PROFILE, ENVIRONMENTAL, SAFETY TANK SYSTEM

REFERENCE TO RELATED PATENT

The innovative capabilities of the inventors hereof in the industrial shipping container art have been previously recognized and established by the U.S. Patent & Trademark Office in the issuance of their U.S. Pat. No. 6,289,684 on Sep. 18, 2001, entitled "Transportable, Self-Contained, Refrigeration System."

TECHNICAL FIELD

The present invention relates to an enclosed, transport, tote tank system of the industrial, heavy-duty type used to transport, for example, hazardous and flammable liquids typically by, for example, offshore/inshore vessels and trucks and more particular to such a tote tank system in which the tank is capable of holding, for example, five hundred and fifty gallons, preferably has a double-skin, gapped construction but with the bottom walls being in face-to-face, flat engagement, and preferably also has a stable, low-profile allowing easy access to its fill opening(s) and any liquid level gauges and is environmentally safe.

BACKGROUND ART

As noted above, the present invention relates to an enclosed, transport, environmentally safe, tote tank system of the industrial, heavy-duty type for transporting, for example, hazardous and flammable liquids by, for example, offshore/inshore vessels and trucks, as well as other transportation means. The "real world," existing, "prior art" tanks currently being used, for example, in the offshore oil industry, generally are unsafe and, for example, offer no effective protection from spills or punctures.

More particularly, some of the "prior art" problems that exist now, which are solved in the exemplary embodiment of the tank of the present invention, are presented below.

1. "Prior Art" Problem—Typically, the "real world," existing "prior art" tote tanks are relatively tall and narrow, e.g., for a five hundred and fifty gallon capacity tank, about a six (6') foot height with about a four (4') foot width (or length), and have their fill valves located on, near or around the tops of the tanks. A worker thus typically has to climb a ladder or platform to fill or physically check the fluid levels of the existing, "prior art" tanks. Exemplary Embodiment's Solution—The preferred tote tank has a stable, low profile design of, for example, about a four (4') foot maximum height, preferably below four foot, three inch (4'3") in height, and about a six (6') width (or length), for a relatively large capacity tank, with, for example, a liquid level gauge and fill cap(s) at the top of the tank but positioned at a level low enough to allow a worker to service the tank while standing on the ground, vessel deck, truck bed or other basic surface. The substantial differences in dimensions for the same capacity tank between the "prior art" and the exemplary embodiment is one of kind, not merely just one of degree.
2. "Prior Art" Problem—When the "real world," existing "prior art" tote tanks tip over, the top, man-hole or man-way cover often just poped off, spilling the contained liquids onto the ground or surroundings. Exemplary Embodiment's Solution—Preferred low profile configuration for the tote tank makes it more difficult to tip over. An encircling guard wall preferably is added around, for example, the gauge area, fill cap(s), vent and level gauge areas. This protects these components from, for example, slings catching any of the vital components, further avoiding, for example, a tip over. Additionally, a very strong fastener system, for example, a series of encircling bolts, is preferably added on the man hole or man-way cover in place of the inadequately fastened cover used on pre-existing tote tanks.
3. "Prior Art" Problem—The "real world," existing "prior art" tote tanks have no protection from over-fill or discharge leaks. As a result, the liquids fall to the ground or to the surroundings. Exemplary Embodiment's Solution—The protection guard wall on top also acts as a containment area for over-spills. A drain tube also preferably is included, preferably between the two, top, double-"skin" walls, extending, for example, to the side of the tank where any "loose" liquids can be discharged properly by removing, for example, an outside plug, inserting a hose going down to a bucket or other suitable container, etc., then removing the inner plug to catch all of the liquid. The liquid discharge area also preferably has a permanently mounted, bottom drip pan to catch any valve-to-hose leaks, etc.
4. "Prior Art" Problem—There typically is no protection on existing "real world," existing "prior art" tote tanks from anyone turning on a discharge valve and releasing liquids into the environs. Exemplary Embodiment's Solution—A discharge valve preferably is positioned or located inside of an enclosing, protective discharge compartment, which also preferably has a lock-able, security, access door that can be locked to make it tamper-proof.
5. "Prior Art" Problem—"Real world," existing "prior art" tote tanks typically are not protected from punctures caused by, for example, forklifts or cranes swinging tank units, for example, off of vessels rocking in heavy seas. Exemplary Embodiment's Solution—The tote tank preferably includes a gapped, double skin construction, but preferably only along the top and side and end walls and not along the bottom, which preferably has the two "skins" in face-to-face, flat engagement.

Some other, additional, preferred, independent features of the exemplary embodiment which improve the "prior art" tote tanks are:

1. Preferably including lock-out holes in association with both the fill cap(s) and the discharge valve. The customer or user thereafter can insert a band or cable thru these holes during the use of the tank. If the band is broken, it is then known that the tank likely has been tampered with and needs to be double-checked.
2. Preferably including one or more internal baffle to avoid a quick shift of contained liquid from side-to-side or end-to-end.
3. Preferably including fork-lift stirrups in association with the base or tank bottom to interface with and thereby secure, the structural, bottom framework of the tank to the tines of a fork-lift while it is being moved about by the fork-lift.
4. Preferably including a suction pressure, dual relief valve to keep the internal tank pressure below, for example, about a one and a half (1.5 psi) pounds per square inch suction and about a five (5 psi) pounds per square inch output pressure.

The tank preferably is designed to carry many, if not all, types of liquids, particularly hazardous or flammable liquids, such as, for example, methanol, jet fuel, diesel and gas chemicals, etc. It can also be used, for further example, to transport, hold and safely store bio-medical liquids.

The double-skin, low-profile, transport, industrial, environmentally safe, tote tank and system of the present invention solve all of these long-standing, great-need problems of the prior art. A great need for solving these problems have existed for a long period of time, and many have unsuccessfully tried to solve them in the past. Substantial commercial success is expected for the preferred of the present invention embodiment and variants thereof.

GENERAL SUMMARY DISCUSSION OF INVENTION

As noted above, the present invention relates to an enclosed, transport, environmentally safe, tote tank system of significant capacity of the industrial, heavy-duty type for transporting, for example, hazardous and flammable liquids by, for example, offshore/inshore vessels and trucks, as well as other transportation means, providing safe, reliable and environmentally safe transportation of various liquids.

The exemplary embodiment of the tank of the system of the present invention includes all of the following, generally independent features:

1. A very stable, low-profile, tote tank of, for example, a maximum of about a four (4') foot height (preferably no more than 4'3" in height) and, for example, a six (6') length from end to end and a width of about four (4') feet from side to side, making a difference in kind (not merely of degree), with, for example, a liquid level gauge and fill opening(s), allowing a worker to service the tank while standing on the ground or other basic surface (vessel deck, truck bed, etc.), while also making the tote tank more difficult to tip over. It should be noted that both the width and the length of the tank preferably are at least comparble to, if not greater than, the height of the tank.
2. An encircling guard wall preferably located around, for example, the gauge area, fill cap, vent and level gauge area, protecting these components from, for example, slings catching any of the outwardly extending, vital components, thereby avoiding, for example, a tip over. Additionally, a very strong fastener subsystem, e.g., a set of encircling bolts, is preferably added on the man hole, man-way. The protection guard wall on top also acts as a containment area for overspills.
3. A drain tube or line preferably going, for example, to the side of the tank where any "loose" liquids can be discharged properly by removing, for example, an outside plug, inserting a hose going down to a bucket or other suitable container, etc., then removing the inner plug to catch all of the liquid.
4. A discharge valve preferably positioned or located inside of a discharge compartment which also preferably has a lock-able door that can be locked to make it tamper-proof. The discharge area also preferably has a permanent mounted drip pan to catch valve-to-hose leaks, etc. The discharge valve line is protectively covered over and preferably effectively sunk into tank, so that, for example, it can not easily get accidentally knocked off.
5. A gapped, double skin construction, but preferably only along the top and side & end walls and not along the bottom, which preferably has the two "skins" in face-to-face, flat engagement, and not gapped.
6. Lock-out holes preferably included in association with the fill cap and the discharge valve. The customer or user thereafter can insert a band or cable thru these holes during the use of the tank. If the band is broken, it is then known that the tank likely has been tampered with.
7. One or more internal baffle(s) preferably included to avoid a quick shift of contained liquid from side to side or end to end as the tank is moved about.
8. Fork-lift stirrups preferably included in association with the base to interface with and thereby secure the structural, bottom framework of the tank to the tines of a fork-lift while it is being moved about by the fork-lift.
9. A suction pressure, dual relief valve preferably included to keep the internal tank pressure below, for example, about a one and a half(1.5 psi) pounds per square inch suction and about a five (5 psi) per square inch output pressure.

And/Or

10. The tank preferably made of metal and more particularly one hundred (100%) percent stainless steel, including preferably all of its basic components.

Other innovations and contributions to the useful arts will become clear from the written description and claims below and from the accompanying drawings.

As previously noted, the tank preferably is designed to carry many, if not all, types of liquids, particularly hazardous materials, such as, for example, methanol, jet fuel, diesel and gas chemicals, etc. The exemplary embodiment can also be used, for further example, to safely and reliably transport, hold and store bio-medical liquids.

BRIEF DESCRIPTION OF DRAWINGS

For a further understanding of the nature and objects of the present invention, reference should be had to the following description, taken in conjunction with the accompanying drawings, wherein:

FIG. 1 is a top perspective view of an exemplary embodiment of the double-skin, low-profile, transport, environmentally safe, tote tank of the system of the present invention, with the cover door to the bottom, discharge outlet being open, exposing the distal end of the discharge valve line; while FIG. 2 is a side view of the of the back side of the tote tank embodiment of FIG. 1 with the bottom discharge outlet, cover door likewise being open.

FIG. 5 is an end view of the discharge end of the tote tank embodiment of FIG. 1, with some of the tank interior parts and covered parts shown in phantom line; while FIG. 5A is a cross-sectional, detail view of the spill collection outlet tube area of the tote tank as shown in FIG. 5 and as indicated by the circular dashed lines "A" of that figure;

EXEMPLARY, CURRENT, BEST MODE FOR CARRYING OUT THE INVENTION

Figure 3:
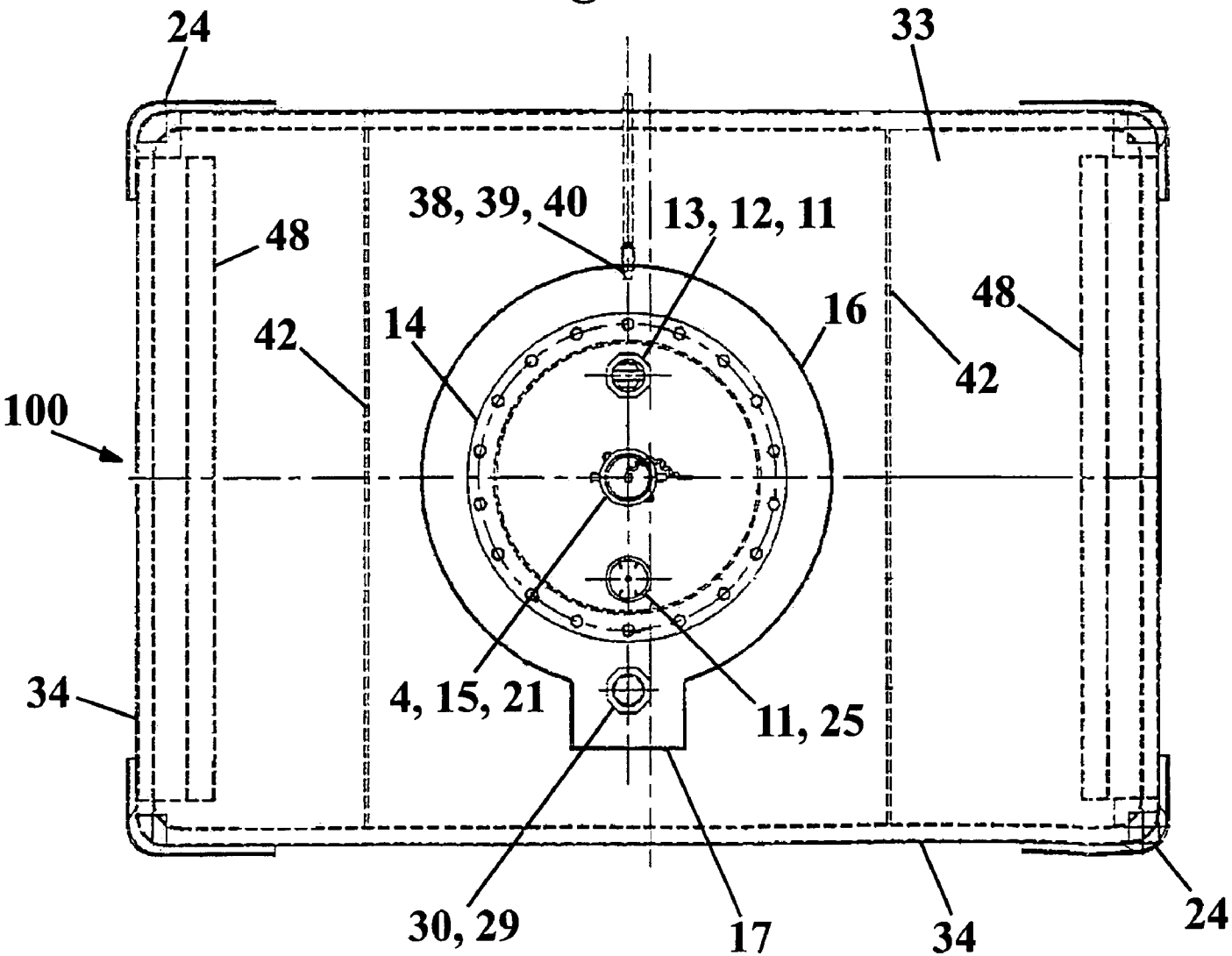
FIG. 3 is a top, view, of the tote tank embodiment of FIG. 1, with some of the interior elements shown in phantom line.

A currently preferred, exemplary embodiment of the double-skin, low-profile, tote tank of the system of the present invention, based on a recently constructed and tested, approximately five hundred and fifty (550 gal.) gallon prototype, tote tank, will be described in detail with reference to the accompanying drawings and in particular to FIGS. 1–8.

It should be understood that the present invention is directed to tanks of the regularly transportable or tote type having a significant capacity, that is, at least about one hundred and fifty gallons and more typically about five hundred or more gallons.

LISTING OF REFERENCE NUMBERS

With reference to FIGS. 1–8 the illustrated reference numbers 1–48 of the currently preferred, exemplary embodiment of the system of the present invention refer to the following parts, with their manufacturing specifications detailed next to each of the referenced elements and the needed number of the parts, all as listed in the following tables.

| NO. | QUANTITY | DESCRIPTION |
|---|---|---|
| 1 | 1 | TOP - 10 GA. (i.e., gauge) - 304 S.S. (i.e., Stainless Steel; INNER) |
| 2 | 2 PC | SHELL - 10 GA. - 304 S.S. (INNER) |
| 3 | 1 | BOTTOM - 10 GA. - 304 S.S. (INNER) |
| 4 | 1 | WIRE SEAL LUG - 10 GA. - 304 S.S. |
| 5 | 2 | RIGHT LEG - 10 GA. × 6" Tall - 304 S.S. |
| 6 | 2 | LEFT LEG - 10 GA. × 6" Tall - 304 S.S. |
| 7 | 8 | CORNER INSERT - 10 GA. × 2½" Tall - 304 S.S. (INNER) |
| 8 | 1 | WARRANTY TAG - ORANGE CARDBOARD |
| 9 | 1 | DECAL - "THIS TANK MUST BE VENTED PRIOR TO DISCHARGE." |
| 10 | 1 | DECAL - "CAUTION! DO NOT PRESSURIZE THIS TANK." |
| 11 | 2 | WELD FLANGE - 2" Size - 304 S.S. |
| 12 | 1 | PLUG with CROSSBAR - 2" Size - 304 S.S. |
| 13 | 1 | GASKET - 2" size - EPT. |
| 14 | 1 | Man-way - 18" DIA. - 304 S.S. BOLTED with EPDM GASKET |
| 15 | 1 | NIPPLE - 3" NPT (National Plumbing Threads) × 1⅜" LG - 304 S.S. |
| 16 | 1 | GUARD, Man-way - 10 GA. × 29" O.D. × 4½" Tall - 304 S.S. |
| 17 | 1 | GUARD, GAUGE - 10 GA. - 304 S.S. |
| 18 | 1 | RECESS OUTLET BACK/TOP - 10 GA. - 304 S.S. |
| 19 | 2 | RECESS OUTLET SIDES - 10 GA. - 304 S.S. |
| 20 | 1 | U.N. TAG. - 304 S.S. |
| 21 | 1 | FUSIBLE CAP - 3" NPS - 316 S.S. "TEFLON" ® GASKET, LANYARD & COMPRESSION SLEEVE |
| 25 | 1 | VENT, PRESS/VAC - 2" NPT, LOW PROFILE, 316L S.S. with "VITON" SEATS, 5.0 PSIG PRESSURE/0.5 PSIG VACUUM - GITS # 1656-200800 |
| 26 | 1 | DECAL |
| 27 | 1 | COUPLING, HALF - 2" NPT 150# - 304 S.S. |
| 28 | 1 | NIPPLE - 2" NPT × 7" LG. (TBE) - 304 S.S. |
| 29 | 1 | COUPLING, HALF - 1½" NPT 150# - 304 S.S. |
| 30 | 1 | GAUGE, LEVEL - 1½" NPT - 304 S.S. with POLY FLOAT |
| 31 | 1 | COUPLING, HALF - ¼" NPT 150# - 304 S.S. |
| 32 | 1 | PLUG, SQ HD - ¼" NPT 150# - 304 S.S. |
| 33 | 1 | TOP - 10 GA. - 304 S.S. (OUTER) |
| 34 | 2 PC | SHELL - 10 GA. - 304 S.S.(OUTER) |
| 35 | 1 | BOTTOM - 10 GA. - 304 S.S. (OUTER) |
| 36 | 8 | CORNER INSERT - 10 GA. × 3" TALL - 304 S.S. (OUTER) |
| 37 | 1 | SPILL PAN - 10 GA. - 304 S.S. |
| 38 | 1 | NIPPLE - ⅜" NPT × 11"LG (TOE) - 304 S.S. |
| 39 | 1 | COUPLING, FULL - ⅜" NPT 150# - 304 S.S. |
| 40 | 1 | PLUG, SQ HD - ⅜" NPT 150# - 304 S.S. |
| 41 | 1 | GUARD, OUTER TANK DRAIN PLUG - 8 GA. - 304 S.S. |
| 42 | 2 | CENTER BAFFLE - ¼" Thick - 304 S.S. |
| 43 | 4 | FORK STIRRUPS - 8 GA. - 304 S.S. |
| 44 | 1 | SECURITY DOOR - 10 GA. - 304 S.S. |
| 45 | 1 | SECURITY DOOR, PIANO HINGE - 10 GA. - 304 S.S. |
| 46 | 2 | LUG, SECURITY LOCK - 8 GA. - 304 S.S. |
| 47 | 2 | INNER BRACING - RECTANGULAR TUBE 1" × 2" × 11 GA. WALL × 65¾" LG - 304 S.S. |
| 48 | 4 | INNER BRACING - RECTANGULAR TUBE 1" × 2" × 11 GA. WALL × 43¾" LG - 304 S.S. |

Exemplary Tank Embodiment (FIGS. 1–8)

Figure 6:
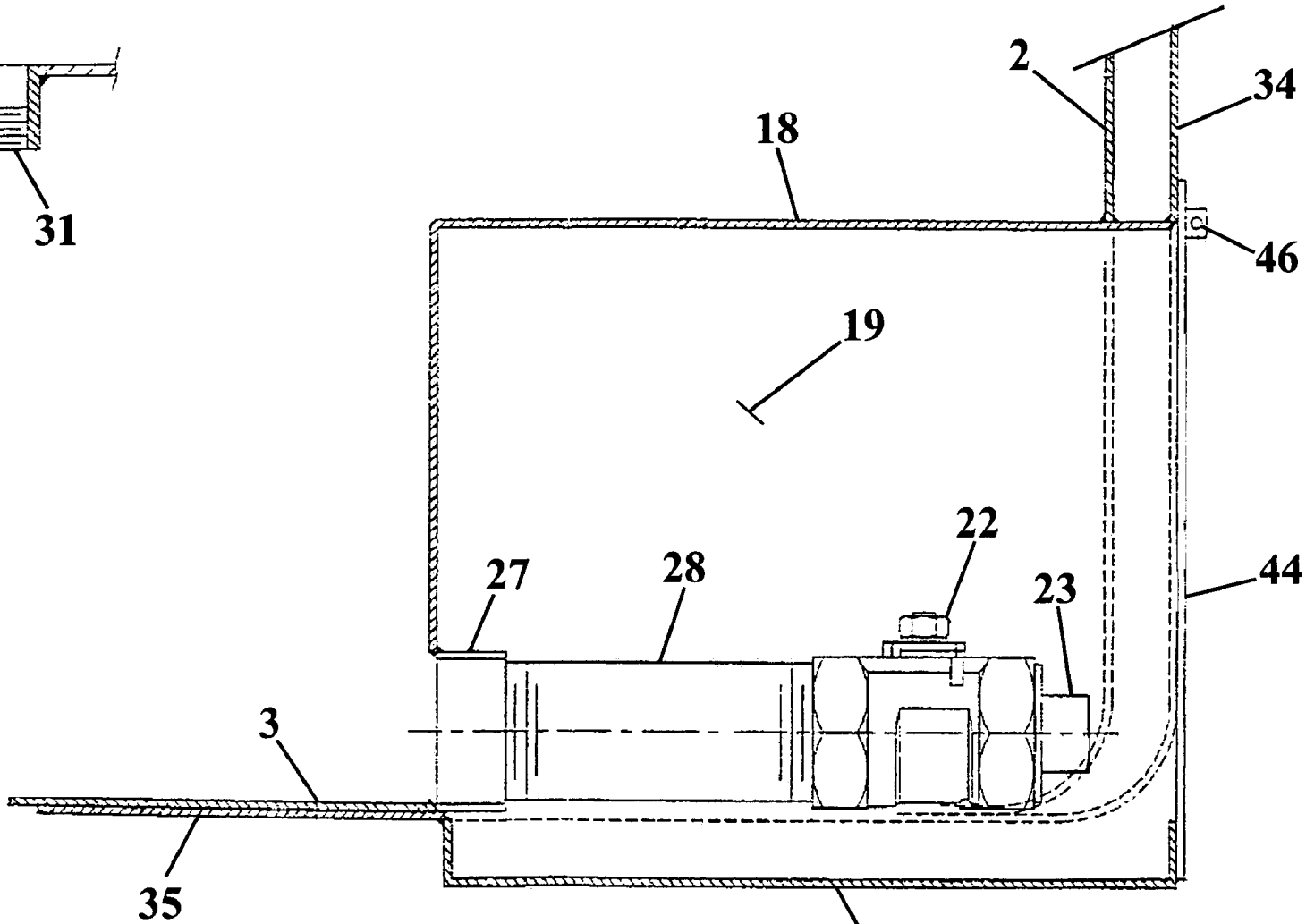
FIG. 6 is a cross-sectional, side, detail view of the bottom discharge outlet and valve of the tote tank of FIG. 1.
Figure 7:
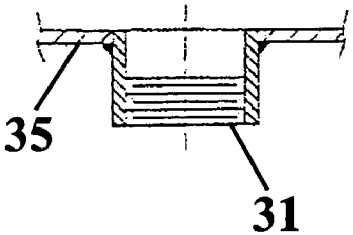
FIG. 7 is a cross-sectional, detail, side view of the coupling used in connection with the drip pan under the discharge line of the tote tank of FIG. 1.
Figure 8:
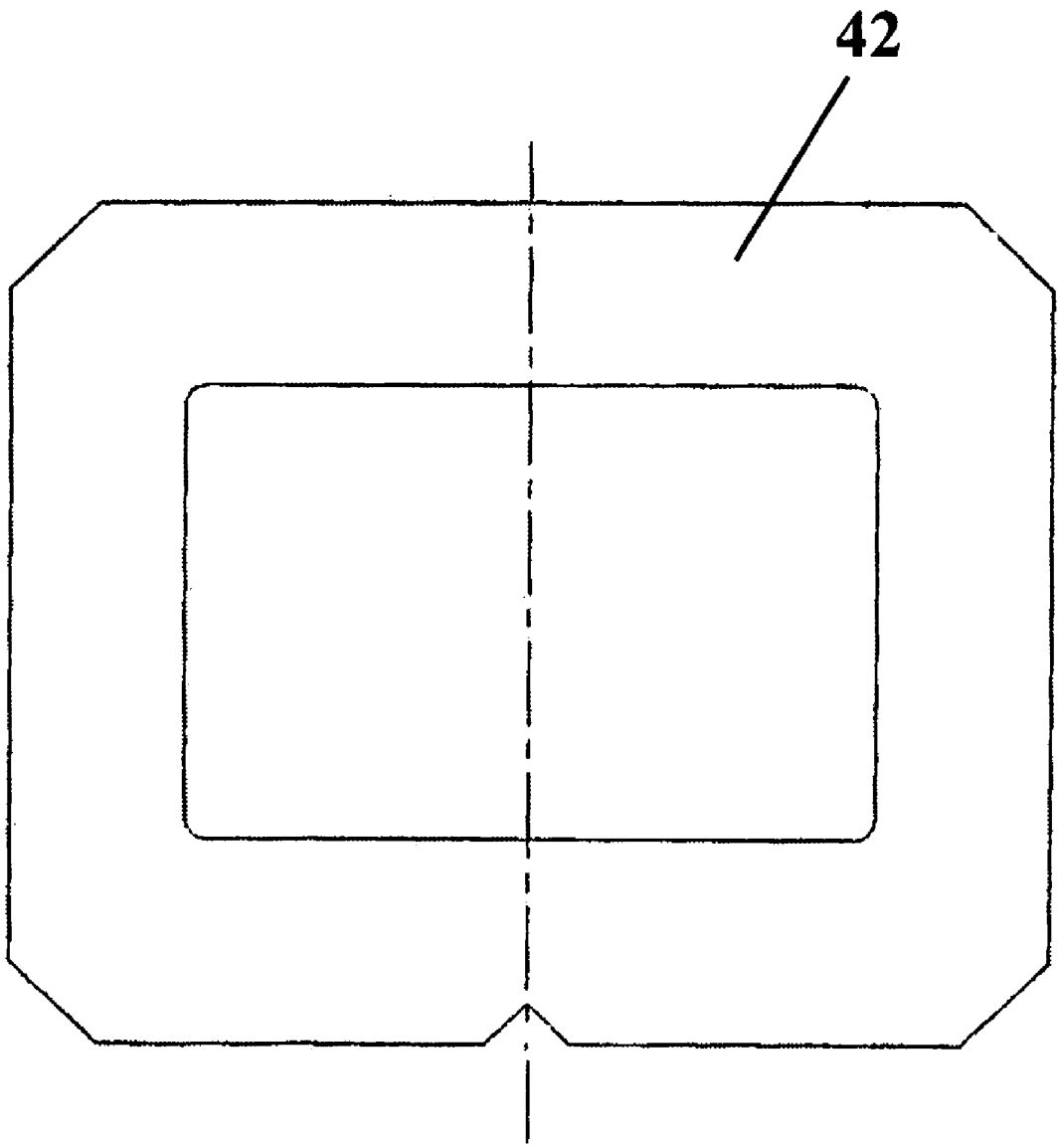
FIG. 8 is a frontal, detail view of an exemplary baffle ring member, a spaced pair of which is used in the interior of the tote tank of FIG. 1.

As can be seen in FIGS. 1–8, an initial, exemplary embodiment of the industrial, double-skin, transport, low-profile, environmental, tote tank 100 of the system of the present invention includes the following basic elements:

a rectangular, inner, fluid containing tank member made up of a series of sheet material forming a top, interior wall member 1, two, interior, side wall members 2, a bottom, interior wall member 3, and two, interior end members (comparable to the side wall members 2 but of a lesser width), collectively together forming a first, interior, tank "skin" which is liquid tight, capable of holding liquid during transport and storage, and a comparable but slightly larger, outer, rectangular, enclosing member, likewise made up of a series of sheet material forming an exterior, top wall member 33, two, exterior, side wall members 34, an exterior, bottom wall member 35, and two, exterior, end wall members (comparable to the side wall members 34 but of a lesser width), collectively together forming a second, exterior "skin," substantially completely enclosing the interior, tank "skin" producing a double wall tank structure, with the respective members of the two, tank "skins" being generally separated by respective gaps, that is separated from each other by, for example, a half (½") inch space, except at their respective bottom members 3/35, which preferably are in face-to-face engagement, that is, flat one on top of the other with no gap (note FIG. 6). Alternatively to using two, originally separate sheets of material for forming the inner and outer bottom wall members and joining them together face-to-face, a single, thicker sheet could be used, although the two, double sheets, as illustrated are preferred.

An exemplary set of off-set braces 47 & 48, best shown in FIGS. 3 & 6, are included between the opposed, interior and exterior wall members (e.g., top wall members 1/33 and side walls 2/34 and the respective end wall members 2/34, but not the bottom wall members 3/35) connecting them together while also maintaining the gap between them. As can be seen, the off-set braces 47 & 48 preferably are made of extended, rectangular tubular members.

Additionally, two sets of eight, inner and outer, protective corner inserts 7, 36, respectively, are included at the eight (four top and four bottom) tank corners to further strengthen the double "skin" structure.

This double "skin" or wall structure substantially protects the interior tank from, for example, puncture, safely containing, for example, hazardous liquids (fuel, toxic chemicals, etc.), while maintaining a very strong, un-gapped bottom.

The tote tank 100 is supported on four, ovally shaped legs 5 & 6, located at the four, bottom corners of the tank for supporting the tank on, for example, the ground, marine deck, truck floor or bed, another like tank for stacking, or other appropriate support surface etc. Four lifting lug, curved, protective corner plates 24 are fixedly attached at the top four corners of the tank 100 for lifting, moving and lowering the tank (empty or filled) by, for example, a crane, while further protecting the corners and holding in or capturing the four legs of another like tank 100 which might be stacked upon it.

In the center area of the top of the tank 100 (note, e.g., FIG. 3) a circular, man-way guard wall 16 with a side, radial extension of interconnected, straight, wall members collectively forming a gauge guard wall 17 are located which together form a completely enclosed, walled-in area which prevents the loss of a reasonable amount of, for example, any spilled liquid. The complete, encircling wall 16/17 extends up above the top wall member at least as high as the gauge and the capped, fill openings, protecting all of them from being engaged by lines, slings and the like, for example, three and three-eights (3⅜") inches and more generally about three to four (3–4") inches.

A circular, man-way cover 14 is located concentrically in the center of the area defined by the circular part 16 of the encircling wall for access into the interior of the tank 100 which is bolted and sealingly gasketed directly or indirectly to at least the exterior, top wall member 33, if not also the interior, top wall member 1, of the double wall, tank structure. Two cap covered and sealed, liquid fill openings of differing diameters [note elements 4, 15 & 21 of, for example, three (3") inch diameter for mating with a three (3") inch fill hose, and elements 11, 12 & 13 of, for example, a two (2") inch diameter for mating with a two (2") inch fill hose] extend down into the interior tank formed by the interior wall members 1–3.

Additionally, a vent, pressure/vacuum relief valve (note elements 11 & 25) also extends down into the interior of the interior tank. This suction pressure, dual relief valve keeps the internal tank pressure below, for example, about a one and a half (1.5 psi) pounds per square inch suction and about a five (5 psi) pounds per square inch output pressure, preventing the tote tank from, for example, collapsing.

Finally, a liquid level, float gauge (note elements 30 & 29) is included at least in part in the area defined by the laterally extending, gauge guard wall 17 in juxtaposition to one side of the tote tank 100 to provide a readily available, exteriorly visual indication of the liquid level of the liquid being held in the tote tank 100. This is in contrast to the tote tanks of the "prior art" in which a worker had to open up the tank and take a physical eye visual or, alternatively, an inserted measurement "stick" to determine the liquid level in the tank, exposing the worker to possible damaging contact with the liquid.

An exemplary height of the tote tank 100 is an over-all height of, for example, fifty and a half (50.5") inch, just a little over four (4') feet, for a five hundred and fifty (550 gal.) gallon tank, in contrast to the much higher, about six (6') feet of the "prior art" tote tanks. The relatively low profile of the tote tank 100 allows a worker to merely stand, on the same surface as that on which the portable tote tank is being supported, next to the tank and then merely stand up straight or easily bend over the top of the tank to either take a liquid level reading or to fill the tank through either of the fill openings, as appropriate to the size of the worker's fill hose. The low-profile design of the tote tank 100 thus avoids the need of a ladder or other supplemental stand or the need to climb up on top of the tank to service it, as was required in the "real world" existing "prior art."

Again, in contrast to the "prior art" tote tanks and as noted above, the encircling, guard, containment wall formed by the man-way guard wall 16 and the gauge guard wall 17 completely surrounds all of the top openings into the interior of the tank 100, which serves to contain any spilled liquid produced, for example, during the filling of the tank, preventing it from spilling out onto the ground or to any workers standing close to the tote tank.

As can best be seen in FIGS. 3 & 6, a normally closed, drain line (note elements 40, 39 & 38), preferably located in and extending through the gapped area between the top wall members 1 & 33 (note FIG. 5A), extends from the inside of the contained areas defined by the man-way and the gauge, containment walls 16/17 out to the exterior at nipple end 38. The drain line also is preferably located laterally and radially out to the side of the tank 100, preferably radially extending out of the side center of the circular man-way wall 16.

When liquid is spilled into the containment areas and it is desired to empty the entrapped liquid from those areas, a tube or hose is connected to end of the nipple 38 [or a container (e.g., bucket) placed under the end of the nipple], and the inner plug 40 is removed, safely allowing the spilled, contained liquid to exit out of the nipple end 38 and be removed and recovered.

Figure 4:
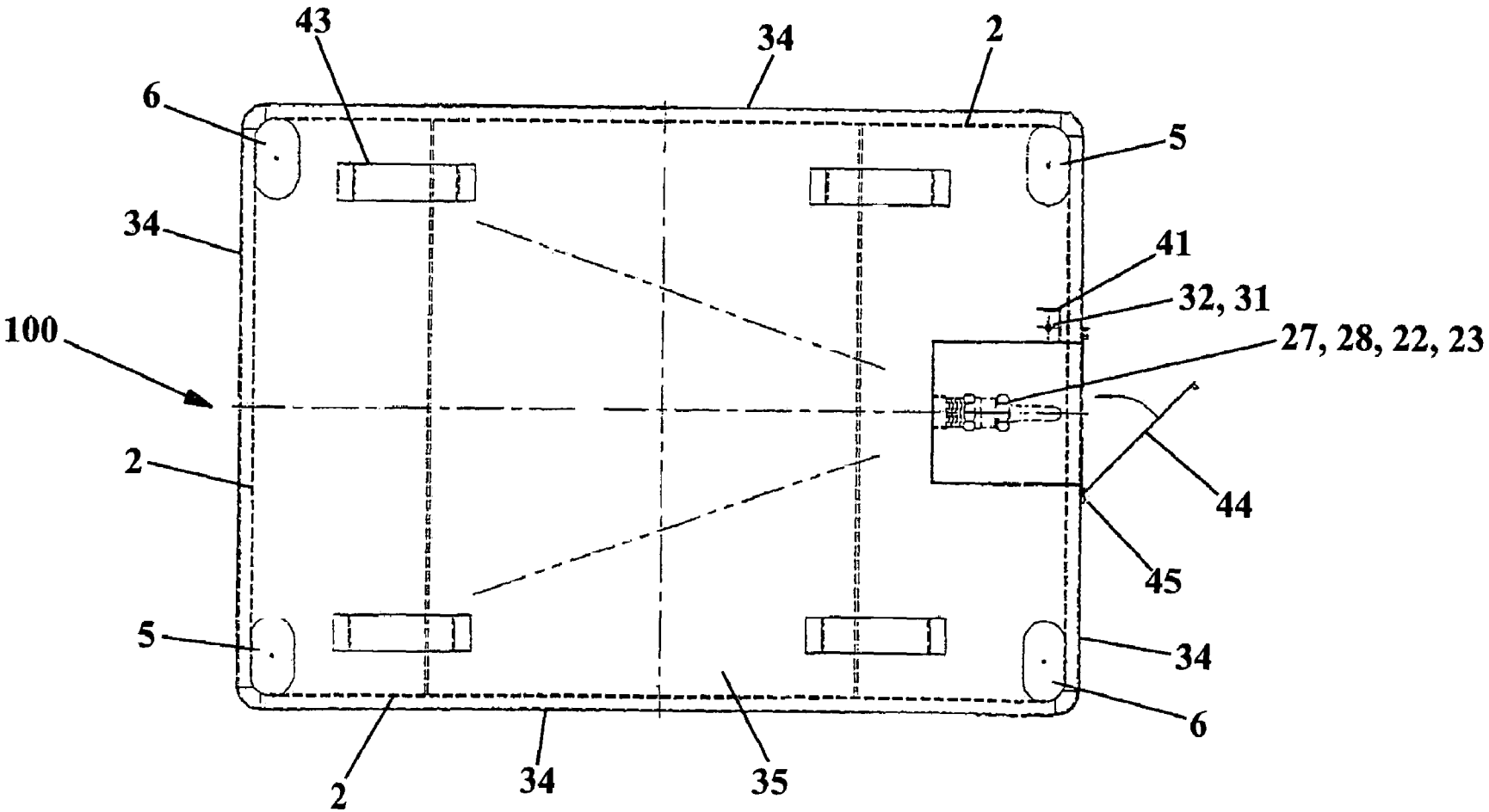
FIG. 4 is a bottom view of the tote tank embodiment of FIG. 1, with the gaped, interior, side and end "skin" walls shown in phantom line, and with the declining or slanted down bottom wall members indicated by a phantom center-line and two, converging, side, diagonal, phantom lines.

With reference particularly to FIGS. 4–6, a discharge line (note elements 27, 28, 22 & 23) extends out from the interior of the inner tank structure at the bottom area of the tank bottom walls 3/35 extending out toward one end of the tank 100 from which the liquid tank can be withdrawn from the tank for, for example, ultimate consumption or use of the liquid. The discharge line is contained within a discharge line box or chamber formed by a drip pan bottom 37, two side walls 19, a back wall and a top 18, with a side-hinged (45) door 44 for access into the discharge line box. The enclosing chamber box effectively protects the discharge valve line and protectively brings it into the tank.

When it is desired to remove the contained liquid, the security door 44 is unlocked or unsealed and opened, and a hose or other line is attached to the end of the discharge line and the liquid then removed from the tote tank 100. If any liquid drips out from this interconnection, it merely drips down into the drip pan 37, again preventing the fluid from falling to the ground or surrounding area. Thus, the drip pan 37 is capable of catching and holding any liquid dripping down from the discharge line and any exterior coupling that might be attached to said discharge line. A normally closed-off, drip pan opening (note elements 32 & 31) is provided in the bottom of the drip pan for easily removing any liquid collected in the drip pan.

A set of four, fork stirrups 43 (note FIGS. 2 & 4) preferably are attached to the bottom of the tank 100 into which a lift truck's forks can be inserted from either side, for safely and stablely moving the tank 100, including when filled, about an area, including stacking one tank on top of another.

A pair of spaced, parallel, open-center baffle plates 42 (note FIGS. 3 & 8) preferably are positioned in the interior of the inner tank structure, extending from side-to-side and with an open center area, to resist the uncontrolled, mass movement from end-to-end of the liquid being carried in interior of the tank 100.

Appropriate tags and signs 8, 9, 10, 20 & 26 are added for informational and directive purposes, as, for example, is specified in the above, reference number tables.

The tank and all of its primary components preferably are made of one hundred (100%) percent stainless steel, for example, ten (10) gauge, "304" stainless steel.

It is noted that the original drawings filed with the application contain detailed, exemplary dimensions which are hereby incorporated herein by reference.

It is expected that the tote tank 100 has the capability of being D.O.T. and C.F.R. 49 certified. Very recently a prototype tank comparable to the above described embodiment was successfully "drop tested" when filled with water [weight of about four thousand, five hundred (4,500#) pounds] and dropped from a height of about eighty-eight (88") inches. There was no significant damage to the dropped tank.

It should be understood that, in using herein either the terms "horizontal" or "vertical," such is being used in a relative sense and not necessarily literally. Thus, for example, those terms would be literal when the legs 5/6 on the bottom of the tank 100 is sitting on a flat, horizontal surface, but only relative when the tank 100, for example, is set at an angle to the true horizontal.

It is noted that the embodiment described herein in detail for exemplary purposes is of course subject to many different variations in dimension, structure, design, application and methodology. Because many varying and different embodiments may be made within the scope of the inventive concepts herein taught, and because many modifications may be made in the embodiment herein detailed in accordance with the descriptive requirements of the law, it is to be understood that the details herein generally are to be interpreted as illustrative and not in a limiting sense.

What is claimed is:

1. An enclosed, regularly transportable, tank system for transporting and providing liquid cargo of significant capacity of at least about one hundred and fifty gallons of the industrial, heavy-duty type for transporting-hazardous and flammable liquids and the like, by offshore/inshore vessels and trucks, as well as other transportation means, and the like, providing relatively safe transportation of the liquids, comprising:

a inner fluid containing tank member made up of
- a top, interior wall member,
- two, interior, side wall members,
- a bottom, interior wall member, and
- two, interior end members, comparable to said interior side wall members but of a lesser width, collectively together forming a first, interior, tank "skin" capable of holding liquid, and a comparable but slightly larger, outer, enclosing, protective member, likewise made up of
- an exterior top wall member,
- two, exterior, side wall members,
- an exterior, bottom wall member, and
- two, exterior, end wall members, comparable to said side wall members, collectively together forming a second, exterior "skin," substantially completely enclosing the interior, tank "skin" producing a double wall tank structure, with the respective members of the two, tank "skins" being generally separated by gaps, except at their respective bottom members, which are at least in substantial part in face-to-face engagement, being flat one on top of the other with substantially no spacing between them;

at least one fill opening extending through both of said top wall members down to the interior of the tank and, with an openable fill cap, also extending above said top wall member of said outer "skin," said fill opening being usable for introducing liquids into said tank interior and, when desired, filling the tank;

a continuous, encircling wall extending up from the top wall member completely surrounding said fill opening, said encircling wall containing and preventing the uncontrolled escape of liquid that might be spilled during the filling operation through said fill opening; and a liquid level gauge measuring the amount of liquid in the tank located adjacent to but laterally spaced from said fill opening and in juxtaposition to one side of the tank, said encircling wall initially forming most of a circle but then having a radially, laterally extended extension in which area said liquid level gauge is located at least in part, while said fill opening is located in the area defined by the circle part of said encircling wall.

2. The portable tank of claim 1, wherein:

the respective gapped wall members are separated from each other by a gap of about a half(½") inch.

3. The portable tank of claim 1, wherein there is further included:

a set of off-set braces of extended tubular construction are included between the opposed, interior and exterior wall members, restricted to only said top wall members and said side walls and said end wall members, fixedly connecting their respective, opposed ones together while also maintaining the gaps between them.

4. The portable tank of claim 1, wherein:

said at least one fill opening through which the tank may be filled has a maximum height of about four (4') feet, with its other, lateral, length & width dimensions being comparable to or greater than said height, providing the portable tank with a stable, low profile and also allowing a worker to service the portable tank while standing on the same surface as that on which the portable tank is being supported.

5. The portable tank of claim 4, wherein:

said second, exterior "skin" has a maximum height of no more than four feet, three inches (4'3").

6. The portable tank of claim 1, wherein:

said encircling wall extends up above said top wall member at least as high as said fill opening with said cap and said liquid level gauge and any other upwardly extending devices located within said encircling wall, protecting said fill opening and cap and said gauge and said other upwardly extending devices from being snagged by lifting lines, slings and the like.

7. The portable tank of claim 1, wherein:

said encircling wall extends up above said top wall member about three to four (~3–4") inches.

8. The portable tank of claim 1, wherein there is further included:

a drain pipe line extending to the interior area defined by said encircling wall located in the gap between said inner and outer top wall members and extending laterally across to the closest side of the tank and being accessible from the side of the tank, said drain pipe line being usable for draining out any spilled liquid entrapped within the area defined by said encircling wall.

9. The portable tank of claim 1, wherein there is further included:

a discharge valve and associated line located at the bottom of the tank enclosed within a closed off compartment within the confines of the outer walls of the tank; and a lock-able but open-able door being an exterior part of said compartment for gaining access to said discharge line from the exterior of the tank for removing liquid from the interior of the tank.

10. The portable tank of claim 9, wherein:

said bottom wall members are downwardly sloped toward said compartment; and wherein there is further included a drip catch pan forming the bottom of said compartment capable of catching and holding any liquid dripping down from the discharge line and any exterior coupling that might be attached to said discharge line.

11. The portable-tank of claim 1, wherein:

said bottom wall members have a thickness greater than any one of the thicknesses of the other of said wall members.

12. The portable tank of claim 1, wherein:

all of said wall members are made of stainless steel.

13. The portable tank of claim 1, wherein the tank has a capacity of about five hundred and fifty gallons, and wherein:

the tank is about six (6') foot in length from end to end and has a width of about four (4') feet from side to side.

14. The portable tank of claim 1, wherein there is further included:

a discharge valve and associated line located at the bottom of the tank enclosed within a closed off compartment located within the confines of the outer side and end wall members of the tank; and a lock-able but open-able door being an exterior part of said compartment for gaining access to said discharge line from the exterior of the tank for removing liquid from the interior of the tank.

15. The portable tank of claim 1, wherein there is further included a compartment, and wherein:

said bottom wall members are downwardly sloped toward said compartment; and wherein there is further included a drip catch pan forming the bottom of said compartment capable of catching and holding any liquid dripping down from the discharge line and any exterior coupling that might be attached to said discharge line.

16. The portable tank of claim 1, wherein there is further included:

a suction pressure, dual relief valve included extending out of said outer tank "skin" and extending into the inner tank "skin" keeping the internal tank pressure below about a one and a half (1.5 psi) pounds per square inch suction and about a five (5 psi) per square inch output pressure.

* * * * *